US011161722B2

(12) United States Patent
Backes et al.

(10) Patent No.: US 11,161,722 B2
(45) Date of Patent: Nov. 2, 2021

(54) TELESCOPIC JIB BRACING DEVICE

(71) Applicant: Manitowoc Crane Group France SAS, Dardilly (FR)

(72) Inventors: Bernd Backes, Oberthal (DE); Dieter Stuehrwoldt, Wilhelmshaven (DE); Franz Bischof, Wilhelmshaven (DE); Jann Reesing, Butjadingen (DE)

(73) Assignee: Manitowoc Crane Group France SAS, Dardilly (FR)

( * ) Notice: Subject to any disclaimer, the term of this patent is extended or adjusted under 35 U.S.C. 154(b) by 0 days.

(21) Appl. No.: 16/455,234

(22) Filed: Jun. 27, 2019

(65) Prior Publication Data

US 2020/0002139 A1 Jan. 2, 2020

(30) Foreign Application Priority Data

Jun. 28, 2018 (DE) ..... 10 2018 115 632.4

(51) Int. Cl.

| | |
|---|---|
| ***B66C 23/00*** | (2006.01) |
| ***B66C 23/82*** | (2006.01) |
| ***B66C 23/70*** | (2006.01) |
| *B66C 23/36* | (2006.01) |

(52) U.S. Cl.

CPC ..... *B66C 23/828* (2013.01); *B66C 23/702* (2013.01); *B66C 23/365* (2013.01); *B66C 2700/0378* (2013.01)

(58) Field of Classification Search

CPC ... B66C 23/821; B66C 23/825; B66C 23/826; B66C 23/365; B66C 23/702; B66C 23/828; B66C 23/0378

See application file for complete search history.

(56) References Cited

U.S. PATENT DOCUMENTS 3,954,193 A * 5/1976 Whittingham ..... B60P 3/28 414/343
2010/0282700 A1* 11/2010 Richter ..... B66C 23/344 212/177

FOREIGN PATENT DOCUMENTS

| | | | |
|---|---|---|---|
| CN | 202766156 | U | 3/2013 |
| CN | 106044589 | A | 10/2016 |
| CN | 105293318 | B | 9/2017 |
| DE | 202005005627 | U1 | 8/2006 |
| EP | 1342692 | A2 | 9/2003 |

(Continued)

OTHER PUBLICATIONS

Extended European Search Report issued by EPO in connection with EP19182128 dated Nov. 28, 2019.

(Continued)

*Primary Examiner* — Emmanuel M Marcelo
(74) *Attorney, Agent, or Firm* — Klintworth & Rozenblat IP LLP

(57) ABSTRACT

A telescopic jib bracing unit for a mobile crane includes a holding frame which is embodied for fastening to the telescopic jib of the mobile crane and exhibits an open cross-section, the cross-sectional opening of which enables the jib to be retracted into the holding frame, and two bracing supports which are connected by the holding frame to form a structural unit. Two frame parts which form the open cross-section of the holding frame are coupled to each other via a coupling point such that they can be moved with respect to each other. A bracing unit transport system, a mobile crane and a fitting method are also provided.

15 Claims, 11 Drawing Sheets

(56) References Cited

FOREIGN PATENT DOCUMENTS

Figure 1:
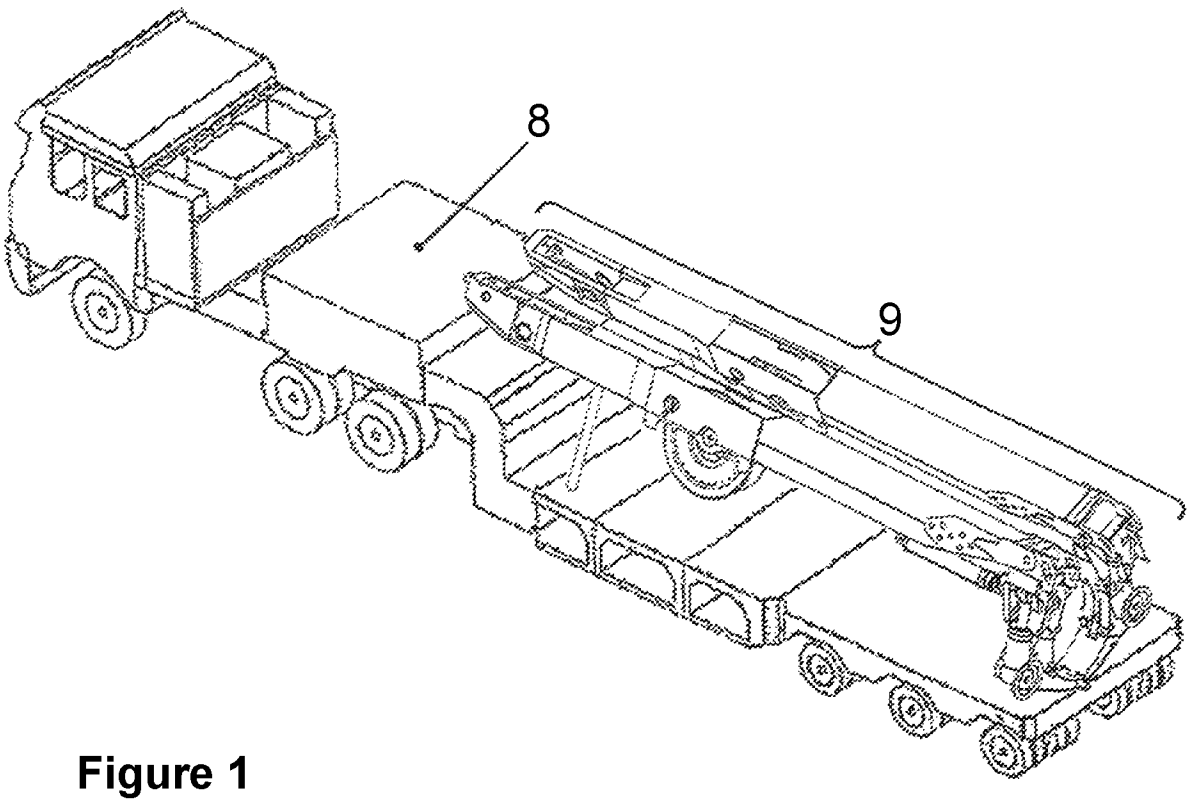

| | | | |
|---|---|---|---|
| EP | 2248754 | A1 | 11/2010 |
| WO | 2005/092775 | A1 | 10/2005 |

OTHER PUBLICATIONS

German Office Action dated Jan. 30, 2019 in connection with corresponding German Patent Application DE 10 2018 115 632.4.

* cited by examiner

TELESCOPIC JIB BRACING DEVICE

The invention relates to the technical field of bracing in telescopic cranes, in particular mobile cranes.

Bracing systems are used in cranes and/or telescopic cranes to increase the load capacity of the jib or to increase its stability and/or rigidity. In many cases, and as in the present invention, the bracing device is provided as an integral unit and is also referred to as the "bracing bracket". It comprises erectable bracing supports and a holding frame for fastening to the crane jib. Cables which are tensed via the bracing supports to the jib head partially absorb the forces acting on the jib and thus ensure that it is relieved and/or that its rigidity is improved. The bracing supports are fastened in the region of the rotational axis of the jib via bracing members.

In larger mobile cranes, the dimensions and weight of the bracing unit also increase, such that the latter cannot be preassembled on the jib when transporting the crane to the site of operation, since height and/or weight limits would otherwise not be observed. In these cases, the bracing unit is moved to the site of operation separately.

Different approaches are then known from the prior art for fitting the bracing device, which has been transported to the site of operation separately, on the crane and/or crane jib. EP 1342695 A2 thus for example proposes transporting the bracing device in two parts and depositing these parts on the crane undercarriage individually for the purpose of fitting. This approach, however, is comparatively elaborate, since the individual parts of the bracing device have to be handled separately. EP 1735233 A1 thus proposes embodying the entire bracing device as a structural unit which can be lifted as one part from the transport vehicle by the crane at the site of operation. In order to fit the bracing device on the jib, the bracing device is deposited on the ground in a raised position by means of a bearing frame, such that the crane jib can be retracted under the bracing device, and the bracing device can be assembled on the jib from above. For this solution, however, a bearing frame for the bracing device has to be provided, and retracting the jib under the bracing device represents an additional procedure. EP 2248754 A1 therefore proposes depositing the bracing device as a structural unit directly on the crane undercarriage in order to assemble the bracing device on the jib "from below" once the jib has luffed out and/or off. Since, in this solution, the luffing cylinder(s) has/have to be guided past the bracing supports, but the design breadth of the bracing device must not exceed a particular value due to regulatory requirements for road transport, this solution is severely limited with regard to the geometry of the bracing device and the jib together with its luffing mechanism.

It is the object of the present invention to provide a bracing device for a mobile crane telescopic jib which can itself be easily fitted and nonetheless fulfils the geometric requirements for road transport even in the case of larger mobile cranes.

The telescopic jib bracing unit in accordance with the invention accordingly comprises: a holding frame which is embodied for fastening to the telescopic jib of the mobile crane and exhibits an open cross-section, the cross-sectional opening of which enables the jib to be inserted into the holding frame; and two bracing supports which are connected by the holding frame to form a structural unit, wherein two frame parts which form the open cross-section of the holding frame are coupled to each other via a coupling point such that they can be moved with respect to each other.

In other words, the holding frame by means of which the bracing supports are fastened to the jib exhibits a substantially U-shaped cross-section, such that in order to fit the bracing device, the jib can be inserted into the holding frame via the opening in the U-shaped holding frame by a luffing movement, and the holding frame can ultimately be bolted to the jib, wherein the open cross-section is formed by at least two and in particular exactly two frame parts which can be moved with respect to each other but which still form a structural unit. It is thus possible to vary the profile cross-section of the holding frame by moving the frame parts with respect to each other, such that different profile cross-sections of the holding frame, which in turn fulfil different geometric requirements of the bracing unit, can be achieved through different arrangements of the frame parts with respect to each other, wherein the holding frame can extend substantially in a plane which perpendicularly intersects the longitudinal axis of the jib which is inserted into the holding frame. The frame parts can also be moved with respect to each other in this plane.

Moving the frame parts with respect to each other can thus for example alter the opening width of the open cross-section. In other words, the frame parts can be moved with respect to each other such that the opening provided for inserting the jib into the holding frame is thus widened or also narrowed again. Since the position of the two bracing supports is determined by the position of the respective frame parts of the holding frame, the width between the bracing supports of the bracing device as a whole is thus also affected.

Conversely, moving the frame parts with respect to each other can also alter the design breadth of the bracing unit. The holding frame can then be embodied such that moving the frame parts with respect to each other varies the breadth of the holding frame and thus also the breadth of the entire bracing unit.

The coupling point can for example couple the respective frame parts of the holding frame to each other rotationally. The frame parts can then for example be connected to each other via a rotational joint, the rotational axis of which extends in particular parallel to the longitudinal axis of the jib which is inserted into the holding frame. The coupling point can also couple the respective frame parts to each other translationally, such that they can for example be shifted relative to each other via a rail-like guide, wherein it is also conceivable for the coupling point to enable a combined rotational/translational movement of the respective frame parts with respect to each other. The coupling point can also lie substantially on the plane of symmetry of the holding frame, such that the holding frame exhibits a substantially symmetrical cross-section in any arrangement of the frame parts with respect to each other.

In order to move the frame parts with respect to each other, the bracing unit can comprise at least one electrically, mechanically or hydraulically driven actuator, by means of which the frame parts of the holding frame can be moved, in particular rotated and/or shifted, relative to each other. Frame parts which are translationally coupled to each other can for example be shifted relative to each other via a hydraulic cylinder, a rack-and-pinion drive, an electric or hydraulic motor or the like, in order to vary the opening width of the open frame cross-section and/or alter the design breadth of the holding frame and/or bracing unit. It is also conceivable for the frame parts to be rotationally moved with respect to each other by means of a hydraulic cylinder or an electric or hydraulic motor arranged in the region of the rotary axis. It is also possible for the frame parts to be moved with respect to each other by an "external" drive, such as a drive on the crane undercarriage or on the transport unit/low loader.

In accordance with another embodiment of the bracing unit in accordance with the invention, the holding frame can also be embodied such that the opening in the open cross-section widens autonomously, i.e. automatically, as soon as it is lifted by the crane. It can autonomously and/or automatically widen in this way even when the bracing unit is in a deposited resting position and in particular when it is deposited on the crane undercarriage for the purpose of fitting. The bracing unit's inclination to widen as soon as it is suspended on the load hook of the crane or deposited on the crane undercarriage can be achieved by suitably choosing the frame geometry and the position of the respective centres of gravity of the frame parts and their abutments.

In accordance with one embodiment of the present invention, the frame cross-section can be transferred from a widened arrangement back into an arrangement abutting the jib cross-section by inserting the jib into the holding frame by way of a luffing movement, wherein as soon as the jib for example presses onto the rotational joint, the frame parts automatically abut the profile of the jib as the jib is inserted, such that the bracing unit can be bolted to the jib in a following step.

It is in principle conceivable for the bracing unit in accordance with the invention, comprising a variable holding frame profile, to be assembled on the jib "from above". As will be shown further below, the present invention also however enables fitting "from below", by inserting the jib into the holding frame by luffing it off and/or out. While a holding frame is necessary in the first case in order to be able to deposit the bracing unit in a raised position, such that the jib can be moved under the bracing unit for the purpose of fitting, the bracing unit can for example be deposited directly on the crane undercarriage in the second case.

In order to be able to position the bracing unit in a defined fitting position on the crane undercarriage, the bracing unit can be provided with defined abutments which then function as positioning aids, so to speak. Suitably positioning these abutments can also mean that the holding frame and/or bracing unit opens and/or widens autonomously under its inherent weight in a deposited resting state.

Although it has always been assumed in the foregoing examples that the bracing unit is dismantled for road transport, it is nonetheless conceivable for it to remain deposited on the crane undercarriage or even bolted to the jib of the mobile crane during transport, as long as the requirements for road transport are observed in these cases.

Another aspect of the present invention relates to a bracing unit transport system which, in addition to the bracing unit described herein, also comprises a transport vehicle which is embodied for transporting said bracing unit.

While the bracing unit can be designed such that it automatically widens, in particular in a resting position deposited on the crane undercarriage, it can in a very similar way be inclined, in co-operation with the dedicated transport vehicle, to reduce its design breadth when it is deposited on the transport vehicle. This can mean not only that the maximum breadth permitted for road transport is not exceeded, but also that a transport vehicle which is as slender as possible can be used.

Another aspect of the present invention relates to a telescopic crane, in particular a mobile crane, comprising: a superstructure which is rotatably arranged on an undercarriage and comprises a telescopic jib comprising multiple telescope sections; and a bracing unit such as has been described herein.

Another aspect of the present invention relates to a fitting method for the telescopic jib bracing unit in accordance with the invention, according to which a bracing unit which is transported separately from the mobile crane is lifted from the transport vehicle and deposited on the undercarriage of the mobile crane, whereupon the jib is inserted into the holding frame by way of a luffing movement and bolted to it.

Figure 2:
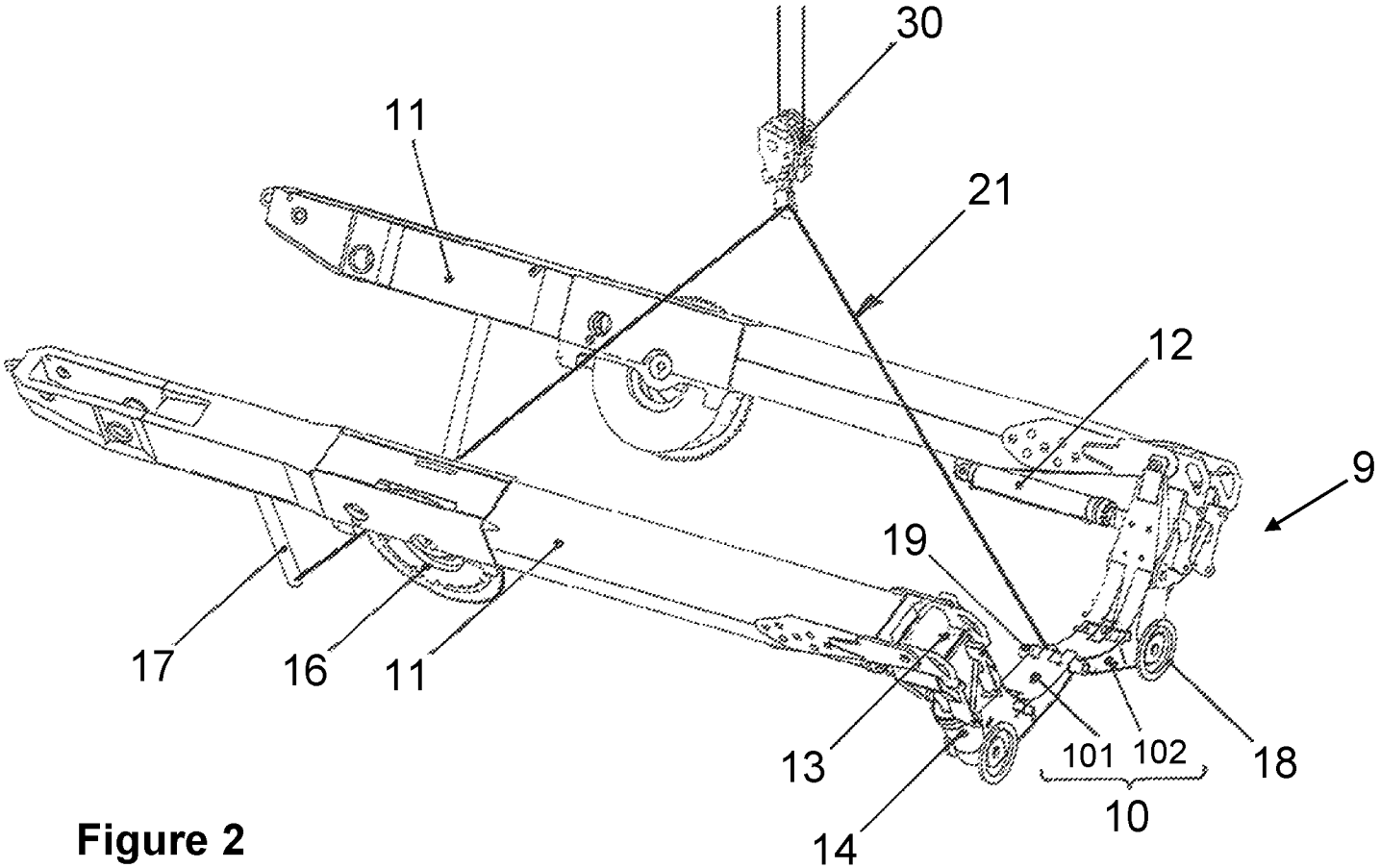
Figure 3:
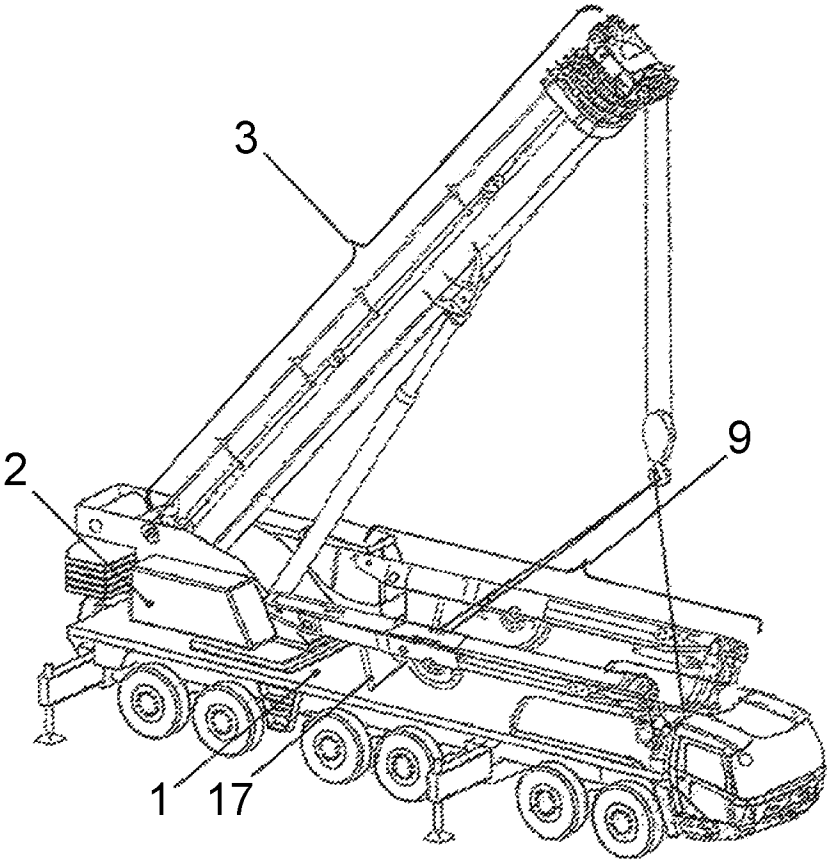
Figure 4:
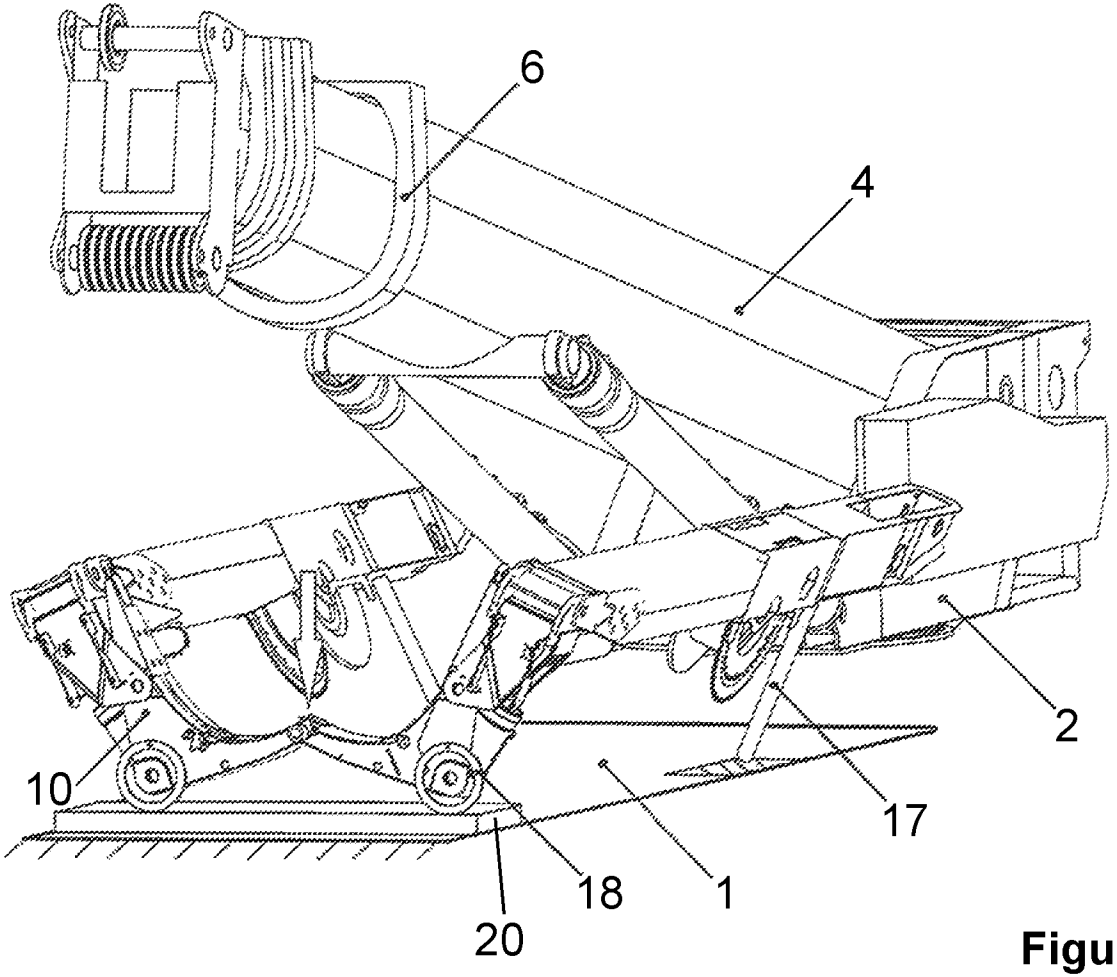
Figure 5:
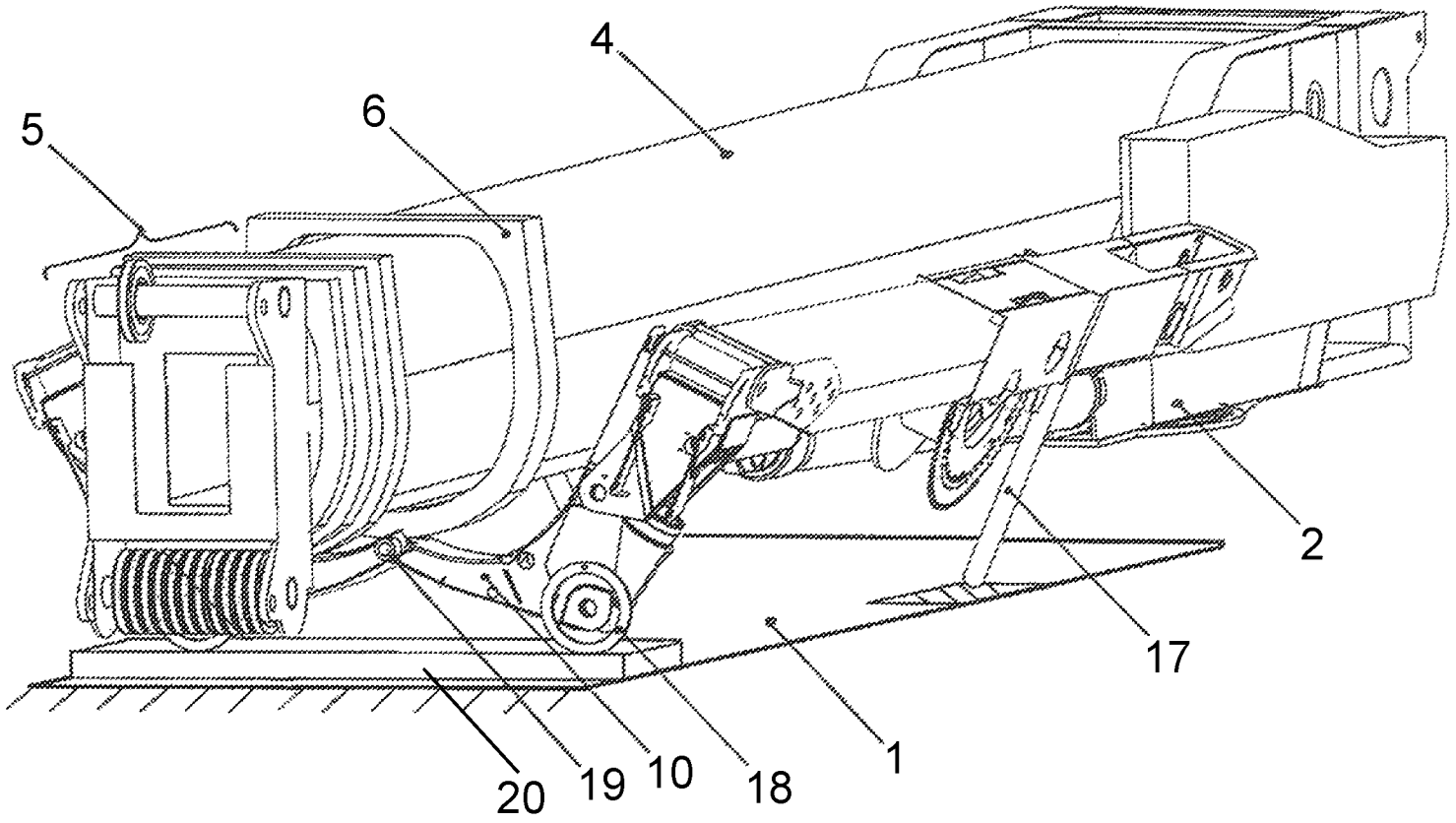
Figure 6:
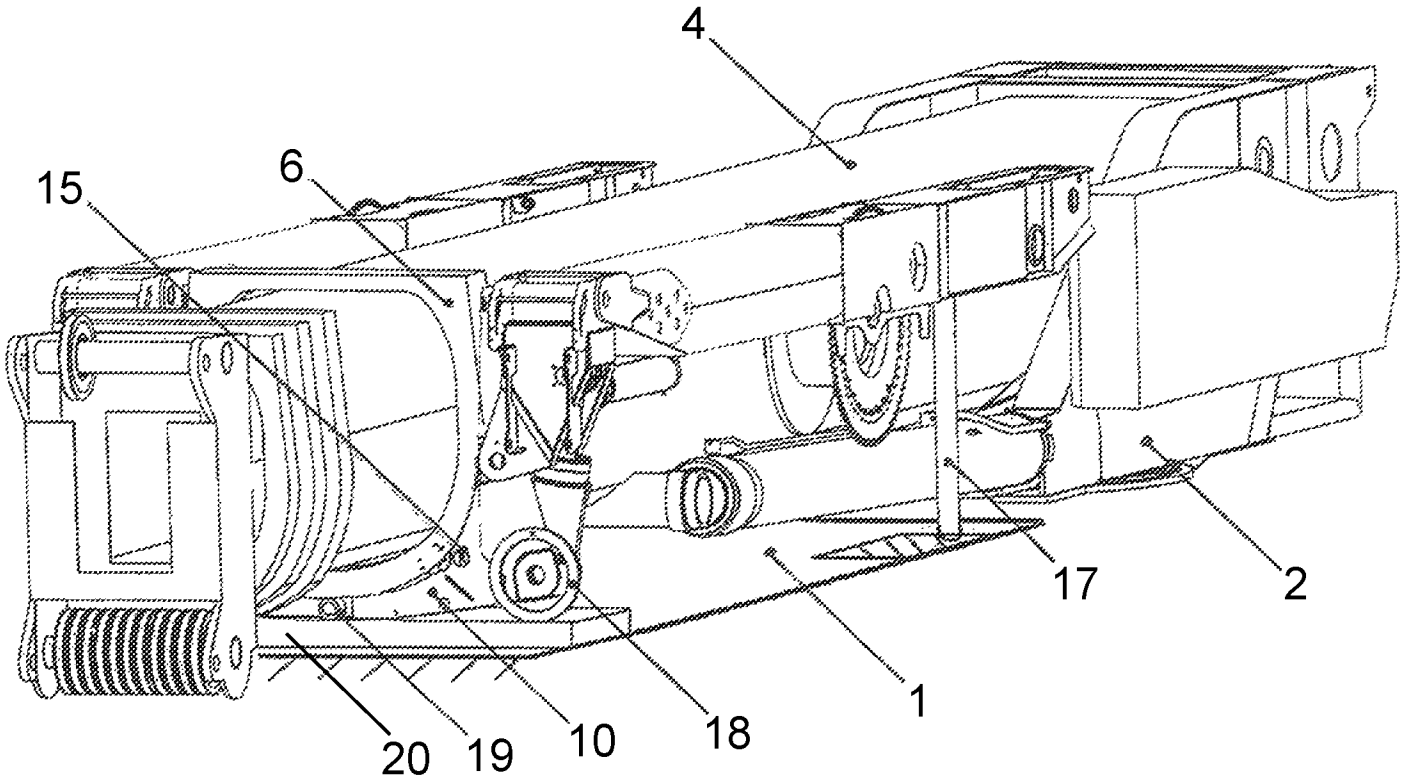
Figure 7:
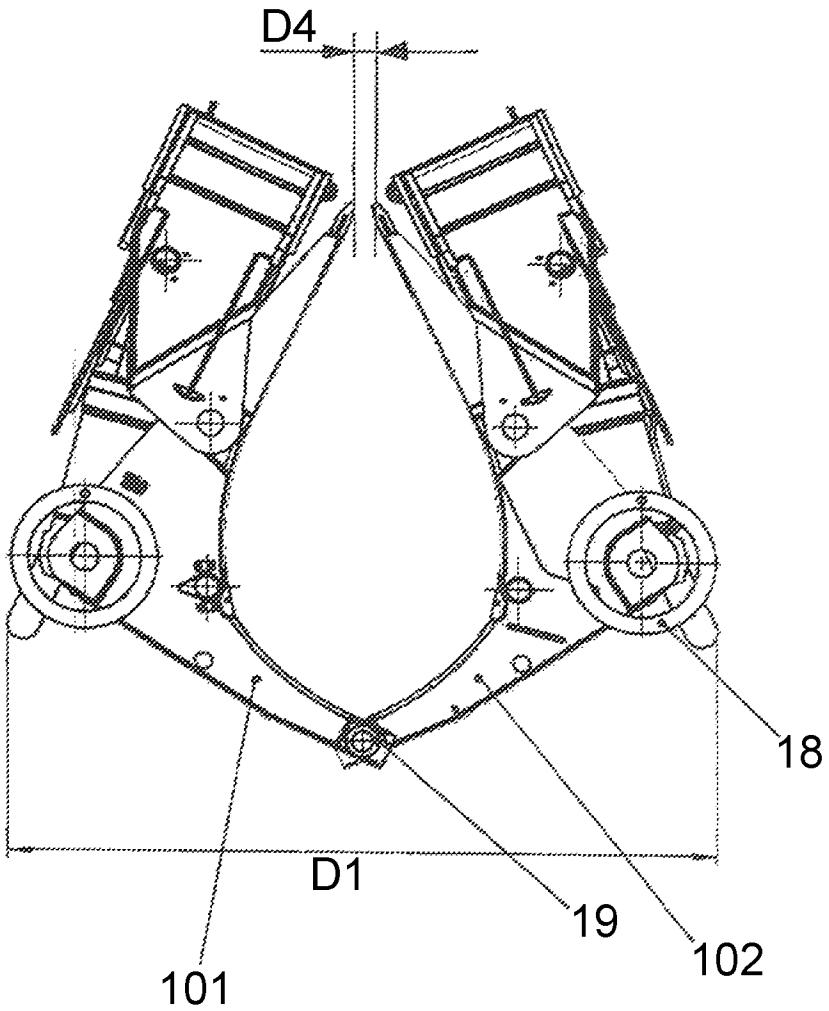
Figure 8:
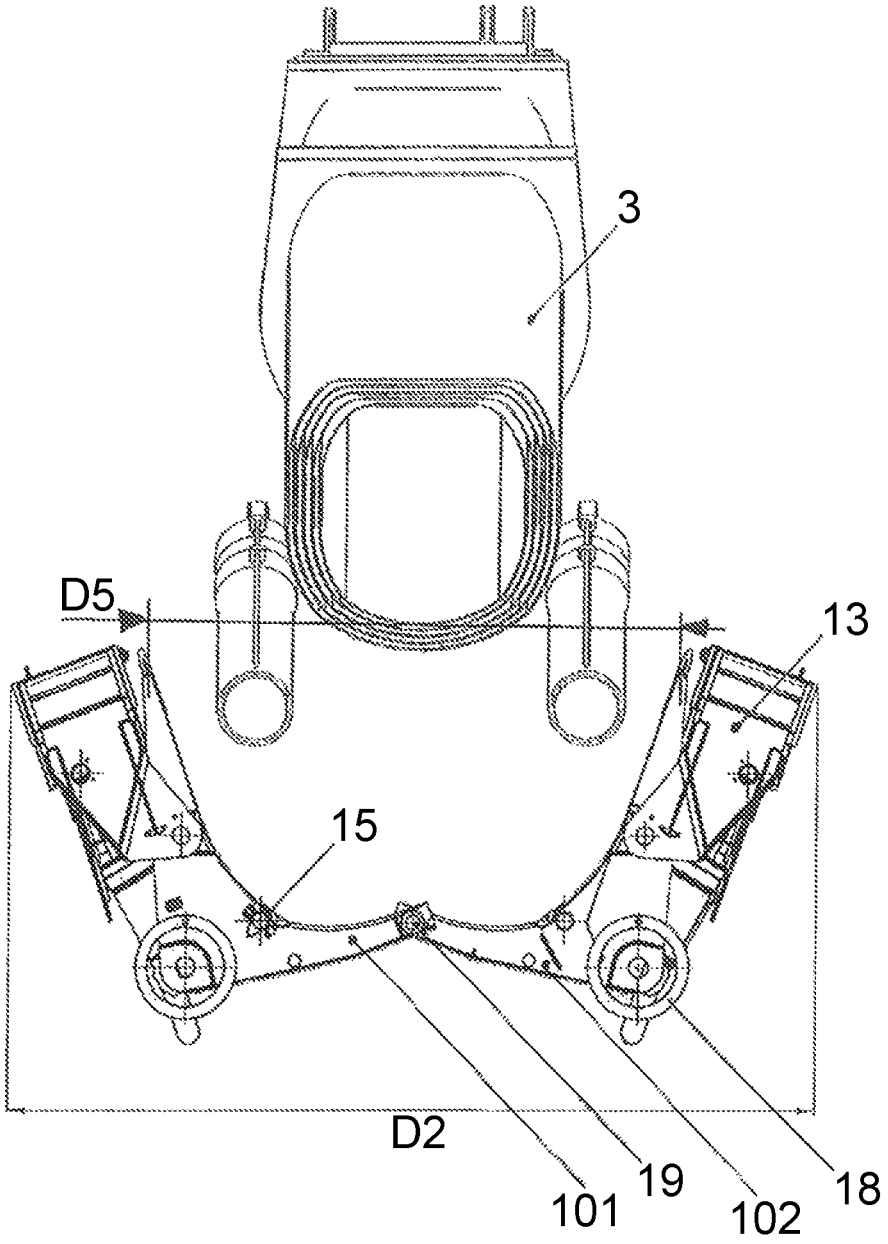
Figure 9:
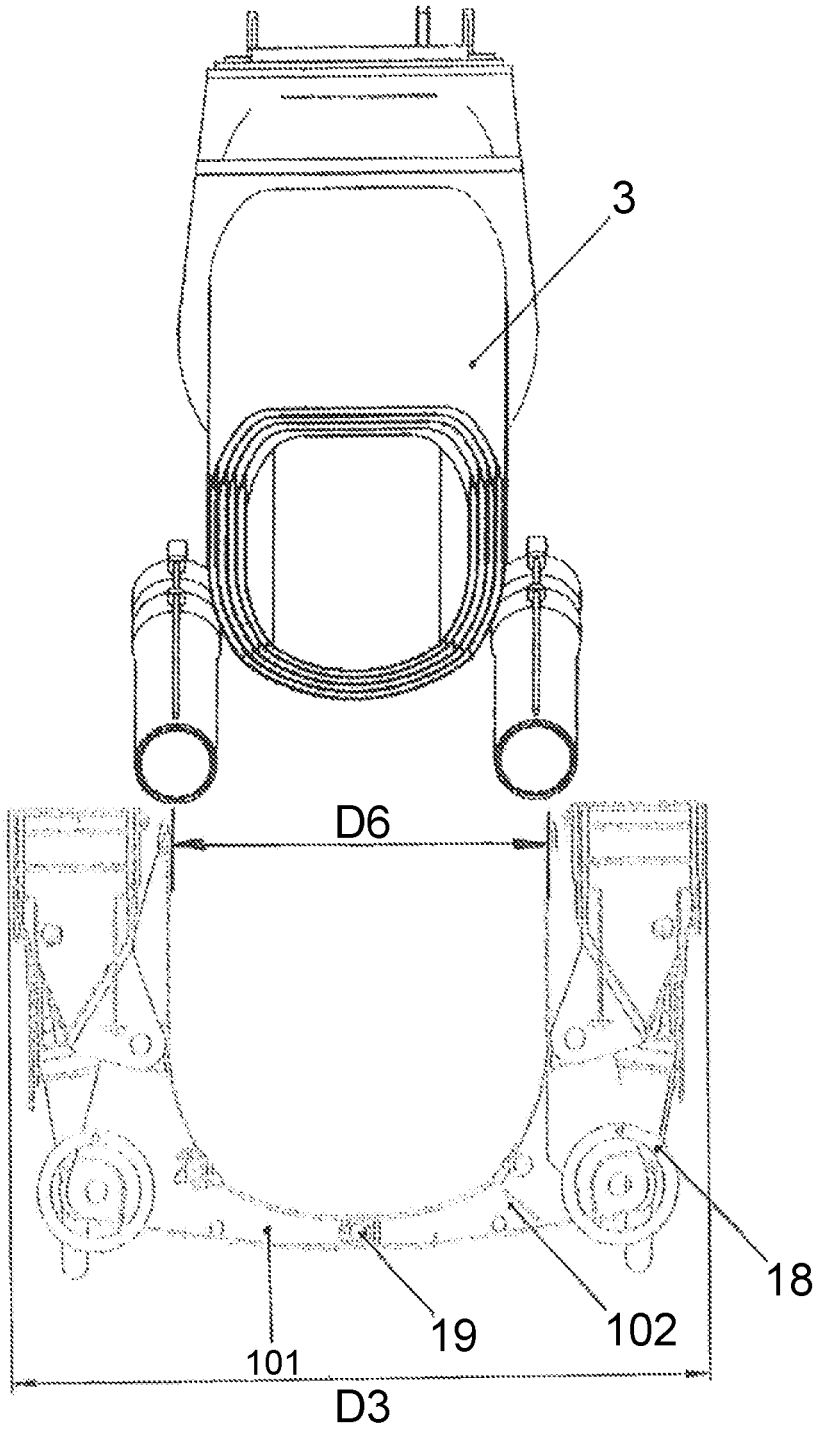
Figure 10:
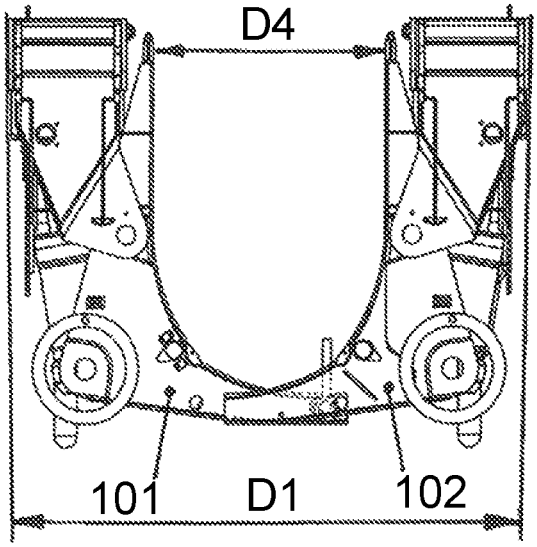
Figure 11:
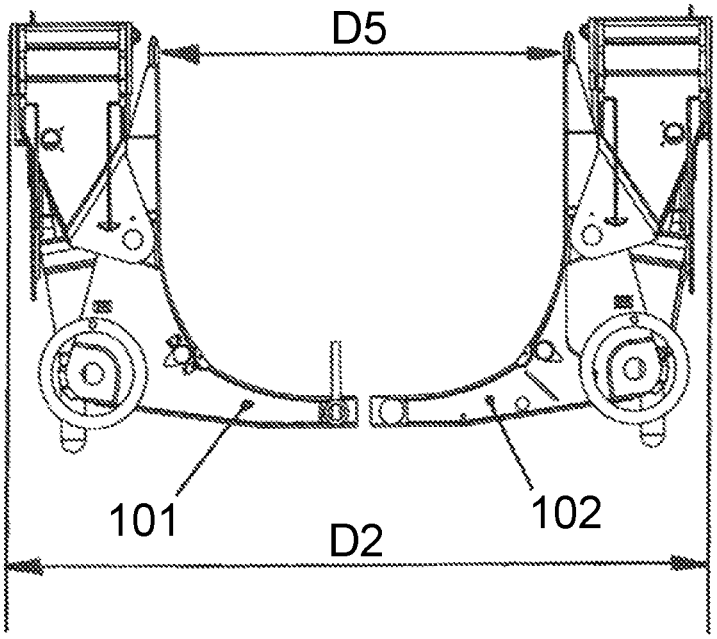
Figure 12:
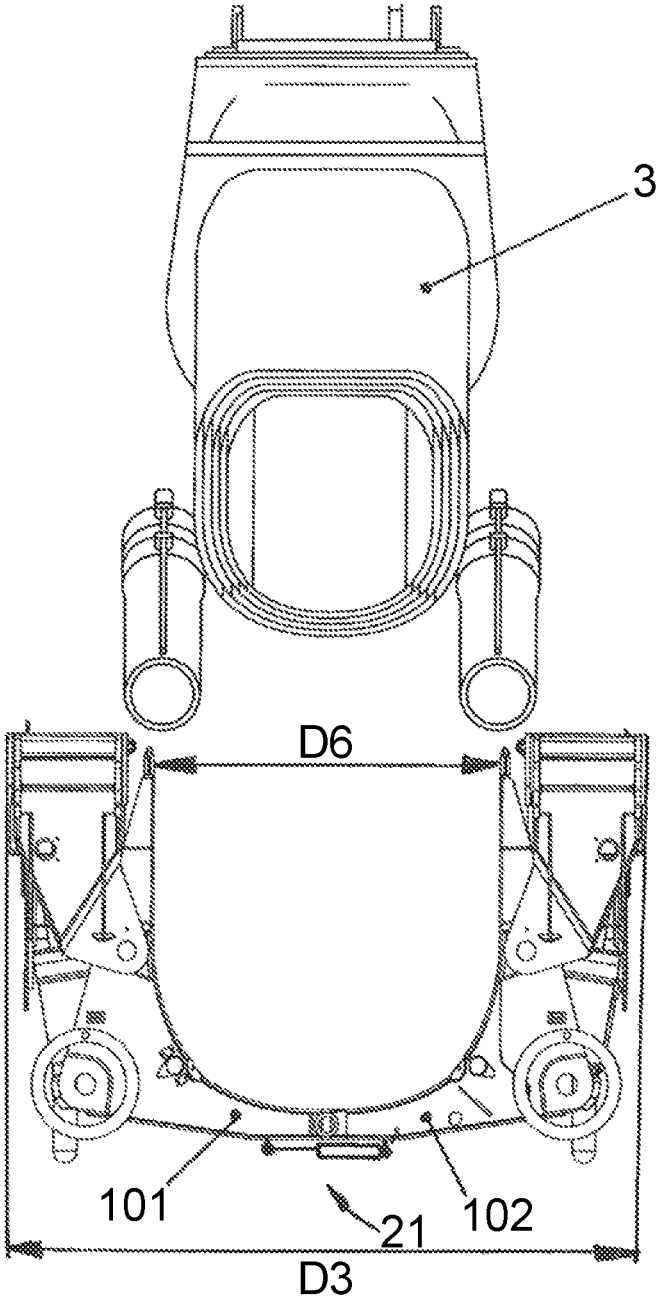

The invention is described below in more detail on the basis of an embodiment and by means of the enclosed drawings. It can comprise any of the features described herein, individually and in any expedient combination. The drawings show:

FIG. 1 a bracing device deposited on a transport vehicle;

FIG. 2 a bracing device suspended on the load hook of a crane;

FIG. 3 a crane comprising a bracing device deposited on its undercarriage;

FIG. 4 the bracing device in a widened resting position on the crane undercarriage;

FIG. 5 a jib which is inserted into the holding frame;

FIG. 6 a bracing device which is bolted to the jib;

FIG. 7 a first embodiment of the bracing device, in a transport arrangement;

FIG. 8 the bracing device from FIG. 7, in a widened resting position;

FIG. 9 the bracing device from FIG. 7, in a normal position corresponding to the jib profile;

FIG. 10 a second embodiment of the bracing device, in a transport arrangement;

FIG. 11 the bracing device from FIG. 10, in a widened resting position;

FIG. 12 the bracing device from FIG. 10, in a normal position corresponding to the jib profile.

FIG. 1 shows a bracing unit 9 in accordance with the present invention, being transported on a low loader 8, separately from the remainder of the mobile crane, wherein the bracing unit 9 assumes a position on the low loader 8 in which it exhibits a smaller design breadth than in an arrangement in which it is deposited on the crane undercarriage 1 or even bolted on the jib 3, wherein FIG. 7 illustrates how the smaller design breadth of the bracing unit 9 can be achieved, namely by turning the two frame parts 101 and 102 about the rotational joint 19, such that the latter assumes a lower position relative to the frame parts 101 and 102 than in a normal arrangement.

FIG. 2 shows a perspective view of the bracing unit 9 in accordance with the invention, which substantially consists of two symmetrically arranged bracing supports 11 and the corresponding holding frame 10, wherein the holding frame 10 is sub-divided into two frame parts 101 and 102 which can be rotated relative to each other about the central rotational joint 19. In the state of the bracing unit 9 shown in FIG. 2, it is suspended on a crane hook 30 by means of the sling 21, wherein the sling and/or cables 21 attach in the region of the rotational joint 19 and the abutment supports 17, such that the bracing device 9 widens autonomously due to its inherent weight, i.e. the frame parts 101 and 102 are rotated about the rotational joint 19 such that the latter comes to rest in a higher position relative to the frame parts 101 and 102 than in a normal arrangement of the holding frame 10, wherein the bracing supports 11 themselves are embodied in a way which is already known. Specifically, they each comprise a winch 16 for bracing the jib and are erected by means of the erecting cylinders 12 in the jib luffing plane and also secured again after use, while they can be moved out of and also back into the jib luffing plane by means of the respective pivot brackets 13 and pivot cylinders 14. The bracing supports 11 can thus assume a so-called V arrangement or Y arrangement, wherein the jib bracing can then also absorb lateral loads, such as wind loads, on the crane jib 3.

FIG. 3 shows the next step in fitting the bracing device 9 in accordance with the invention, in which the latter is deposited in the front region of the crane undercarriage 1. It demonstrates that the bracing unit 9 can be independently positioned on the crane undercarriage 1 by the mobile crane, such that separate lifting gear does not have to be provided.

FIG. 4 shows the bracing unit 9 fully positioned on the crane undercarriage 1, wherein it should be noted that the abutments 17 and 18 of the bracing unit 9 come to rest in defined regions of the crane undercarriage 1, in order to be able to bolt the bracing unit 9 to the jib 3 as soon as the latter has been inserted into the holding frame 10 and/or the frame parts 101 and 102 of the holding frame 10. In the embodiment shown, the holding frame 10 is bolted to the collar 6 of the base body 4. For this purpose, the jib 3 has to be lowered (luffed off and/or out) into a substantially horizontal position, such that the collar 6 is inserted into the holding frame 10 and comes to rest in the holding frame 10. An essential aspect of the present invention can likewise be gathered from FIG. 4: as can be gathered from the foregoing FIGS. 1 to 3, the bracing supports 11 of the bracing device 9, which is separated from the remainder of the mobile crane, are aligned parallel to each other. When the holding frame 10 is rigid, with an invariable profile and an open cross-section, the space provided between the bracing supports 11 is thus directly dependent on the distance between the upper ends of the U-shaped holding frame 10. If more space is needed for inserting the jib 3 into and extending it out of the holding frame 10 again, this has hitherto been possible only by increasing the design breadth of the holding frame 10. When being transported on a low loader 8 separately from the mobile crane, however, the holding frame 10—as also the entire bracing device 9 itself—must not exceed a given maximum breadth. In large mobile cranes which exhibit correspondingly large jib cross-sections, as equally with cranes comprising twin luffing cylinders which extend beyond the lateral breadth of the jib 3, it has for this reason been hitherto near-impossible to implement a bracing unit 9 which can be fitted on the jib 3 "from below". As can be gathered from FIG. 4, widening the holding frame 10 and thus also the entire bracing unit 9 additionally enables the luffing cylinders, which are arranged on both sides of the jib 3, to be guided past the bracing supports 11 without any problems.

As soon as the luffing cylinders have been guided past the bracing supports 11, and the jib 3 and/or the collar 6 of the outermost telescope section 4 has been submerged into the holding frame 10, the bracing supports 11 can be guided back to the jib 3 by abutting the frame parts 101 and 102 against the jib 3 and/or the collar 6. In the example shown, this is achieved by the collar 6 running onto the rotational joint 19, which lies centrally below it, and pressing the latter downwards, wherein the abutments 18 which are provided on both sides of the holding frame 10 and support it roll off on the crane undercarriage 1 and thus enable the respective frame parts 101 and 102, which lie on the crane undercarriage 1, to rotate. The same applies to the abutments 17 below the bracing supports 11, wherein in the example shown, the abutments 18 on the crane undercarriage 1 fulfil the additional function of guiding the holding frame 10 on the crane undercarriage 1 as it is placed onto the jib 3. For this purpose, a rail-like guiding structure 20 (FIGS. 4 to 6) is provided on the undercarriage 1, which enables the abutments 18 to roll off but prevents them from moving in the longitudinal direction of the crane. This can for example be achieved by one or more grooves and/or rails transverse to the longitudinal direction of the crane, in which the abutments 18 are held by the inherent weight of the bracing device 9, even when they are rolling off on the crane undercarriage 1. If the frame parts 101 and 102 can be shifted translationally with respect to each other, the guiding structure 20 can be adapted to the translational (rather than rotational) movement, in order to fulfil the same function.

In general terms, the guiding structure 20 can enable the frame parts 101 and 102 and/or their abutments 18 to move during fitting but prevent them from moving in the longitudinal direction of the crane. Such a guiding structure can also be provided for the rearward abutments 17. Since, in the embodiment shown, the latter lie on the crane undercarriage 1 at substantially the same point when rolling off, the guiding structure at said location can take the form of an indentation or recess on the crane undercarriage 1 which prevents the respective abutments 17 from moving translationally in any horizontal direction. If such a translational movement—such as a movement in the transverse direction of the crane—is desirable, the guiding structure for the rear abutments 17 can of course likewise comprise rails or grooves such as have already been described for the front guiding structure 20.

FIG. 6 shows the holding frame 10 of the bracing unit 9 in accordance with the invention, in a state in which it is placed onto the jib 3 and in which the holding frame 10 can be bolted to the collar 6 of the outermost telescope section 4 by activating the locking cylinders 15.

The cross-sections of the different arrangements of the frame parts 101 and 102 with respect to each other shown in FIGS. 7 to 9 illustrate again the advantages of the present invention: FIG. 9 shows a normal arrangement of the frame parts 101 and 102 relative to each other, in which the holding frame 10 abuts and can be bolted to the collar 6 and/or the outer circumference of the jib 3. In this arrangement, it is not possible to insert the jib 3 into the holding frame 10 and/or extend it out of the holding frame 10 again, since the available opening width D6 is not sufficient for this purpose. It is also possible for the design breadth D3 shown in FIG. 9 to exceed a permitted maximum value for road transport.

The present invention remedies both problems by pivoting the frame parts 101 and 102 with respect to each other via the central rotational joint 19. On the one hand, this enables the opening width of the holding frame 10, which is relevant to inserting and extending again, to be widened to a larger distance D5, wherein the design breadth D2—which is likewise increased relative to the design breadth D3 of the normal arrangement—is irrelevant, since this arrangement is not assumed until the mobile crane is fitted at the site of operation. For road transport, the frame parts 101 and 102 of the embodiment shown are pivoted in opposite directions with respect to each other, such that the design breadth D1 of the bracing device 9 assumes a value which is permitted for road transport and smaller than the design breadth D3 of the normal arrangement. The opening width D4, which is reduced relative to the normal arrangement, is again irrelevant in the transport state.

FIGS. 10 to 12 show an embodiment of the bracing device 9 in accordance with the invention in which the frame parts 101 and 102 are moved translationally with respect to each other, rather than rotationally as in the embodiment shown in FIGS. 7 to 9. This translational movement in the horizontal direction is generated by an actuator 21 which in FIG. 12 is shown schematically as a hydraulic cylinder but can equally comprise a rack-and-pinion drive or similar means suitable for translational movement. While FIG. 10 shows a transport arrangement which exhibits reduced breadths D1 and D4 (corresponding to the rotational arrangement shown in FIG. 7), FIG. 11 shows a fitting arrangement which exhibits extended breadths D2 and D5 (corresponding to the rotational arrangement shown in FIG. 8), and FIG. 12 shows an operating arrangement of the frame parts 101 and 102 (corresponding to the rotational arrangement shown in FIG. 9), wherein in the latter arrangement, the frame parts 101 and 102 can be bolted to the crane jib 3.

The invention claimed is:

1. A telescopic jib bracing unit for a mobile crane, comprising:

a holding frame configured for fastening to the telescopic jib of the mobile crane and having an open cross-section configured to enable the jib to be inserted into the holding frame; and two bracing supports connected by the holding frame to form a structural unit, wherein two frame parts forming the open cross-section of the holding frame are coupled to each other via a coupling point such that they are movable with respect to each other.

2. The bracing unit according to claim 1, wherein the two frame parts are coupled to each other such that moving the frame parts with respect to each other alters an opening width of the open cross-section.

3. The bracing unit according to claim 1, wherein the two frame parts are coupled to each other such that moving the frame parts with respect to each other alters a design breadth of the bracing unit.

4. The bracing unit according to claim 1, wherein the two frame parts are coupled to each other rotationally via the coupling point by a rotational joint, a rotational axis of which extends specifically parallel to a longitudinal axis of the jib.

5. The bracing unit according to claim 1, wherein the two frame parts are coupled to each other translationally via the coupling point by a guide.

6. The bracing unit according to claim 1, wherein movement of the two frame parts is assisted and generated by an actuator having at least one hydraulic cylinder.

7. The bracing unit according to claim 1, wherein the holding frame is configured such that the opening in the open cross-section widens autonomously in a suspended state and/or in a resting position deposited on a crane undercarriage.

8. The bracing unit according to claim 1, wherein the holding frame is configured such that the two frame parts autonomously abut the jib as the jib is inserted into the holding frame.

9. The bracing unit according to claim 1, wherein the holding frame has a cross-section which opens upwards and enables the bracing unit to be fitted by luffing the jib off and/or out.

10. The bracing unit according to claim 1, wherein the bracing unit is configured to be deposited on an undercarriage of the mobile crane for the purpose of fitting using the mobile crane itself.

11. The bracing unit according to claim 1, wherein the bracing unit is provided with defined abutments via which it can be deposited on an undercarriage of the mobile crane and/or on a transport vehicle.

12. The bracing unit according to claim 1, wherein the bracing unit is configured to remain deposited on an undercarriage of the mobile crane and/or bolted to the jib of the mobile crane during transport.

13. A bracing unit transport system, comprising:

the bracing unit according to claim 1; and a transport vehicle configured for transporting the bracing unit, wherein the bracing unit and/or the transport vehicle is/are configured such that a design breadth of the bracing unit deposited on the transport vehicle is reduced autonomously.

14. A telescopic crane comprising:

an undercarriage and a superstructure rotatably arranged on the undercarriage and on which a luffing jib is arranged which comprises an outer base part of the jib and one or more telescopic parts of the jib; and the bracing unit according to claim 1.

15. A method for fitting a telescopic jib bracing unit on a mobile crane, comprising the steps of:

providing the bracing unit according to claim 1 which can be transported separately from the mobile crane;

depositing the bracing unit on an undercarriage of the mobile crane using the mobile crane itself;

positioning the bracing unit on the jib by a luffing movement of the jib; and bolting the bracing unit to the jib.

* * * * *